United States Patent [19]

Mandel

[11] Patent Number: 4,829,909

[45] Date of Patent: May 16, 1989

[54] MATERIAL TRANSPORTING ARRANGEMENT

[76] Inventor: Ronald L. Mandel, 9115 Old State Rd., Evansville, Ind. 47711

[21] Appl. No.: 122,709

[22] Filed: Nov. 19, 1987

[51] Int. Cl.[4] ..... B65D 19/44

[52] U.S. Cl. ..... 108/55.5; 108/54.1

[58] Field of Search ..... 108/55.5, 55.1, 56.1, 108/56.3, 54.1, 53.1, 55.3, 52.1, 53.5; 206/600

[56] References Cited

U.S. PATENT DOCUMENTS

| | | | |
|---|---|---|---|
| 2,643,081 | 6/1953 | Spring | 108/56.1 X |
| 2,739,776 | 3/1956 | Terando | 108/54.1 |
| 3,478,995 | 11/1969 | Lautzenhiser et al. | 108/55.5 X |
| 3,541,977 | 4/1970 | Waldman | 108/53.1 |
| 3,695,187 | 10/1972 | Weiss | 108/54.1 |
| 3,858,723 | 1/1975 | Weiss | 108/55.3 X |
| 4,019,635 | 4/1977 | Boots | 108/55.1 X |
| 4,257,523 | 3/1981 | Blasio | 108/55.3 X |
| 4,475,704 | 10/1984 | Marom et al. | 108/55.1 X |
| 4,625,869 | 12/1986 | Kuipers | 108/56.1 X |
| 4,705,276 | 4/1987 | Kastle et al. | 108/54.1 X |

FOREIGN PATENT DOCUMENTS

| | | | |
|---|---|---|---|
| 189183 | 4/1964 | Sweden | 108/56.1 |
| 701869 | 12/1979 | U.S.S.R. | 108/55.5 |

*Primary Examiner*—Kenneth J. Dorner
*Assistant Examiner*—José V. Chen
*Attorney, Agent, or Firm*—Warren D. Flackbert

[57] ABSTRACT

A material transporting arrangement characterized by a base member presenting a core having integral or separable outwardly extending arms, where the upper surface of the core and the arms are coplaner and serve to receive material, such as rolled metal stock. The aforesaid arms include inverted T-shaped slots which are adapted to receive and retain the free ends (because of configuration) of tie straps which overlay the material. In one form, separable arms are provided, such being slidable into the form cutouts or recesses in the core to accommodate differences in rolled coil diameter size. With an integral core and arm arrangement, the unit is designed for a particular size rolled coil diameter. Coil edge protectors may be provided and, for durability, the base and the arms are made from a high density plastic resin.

8 Claims, 2 Drawing Sheets

FIG. 1
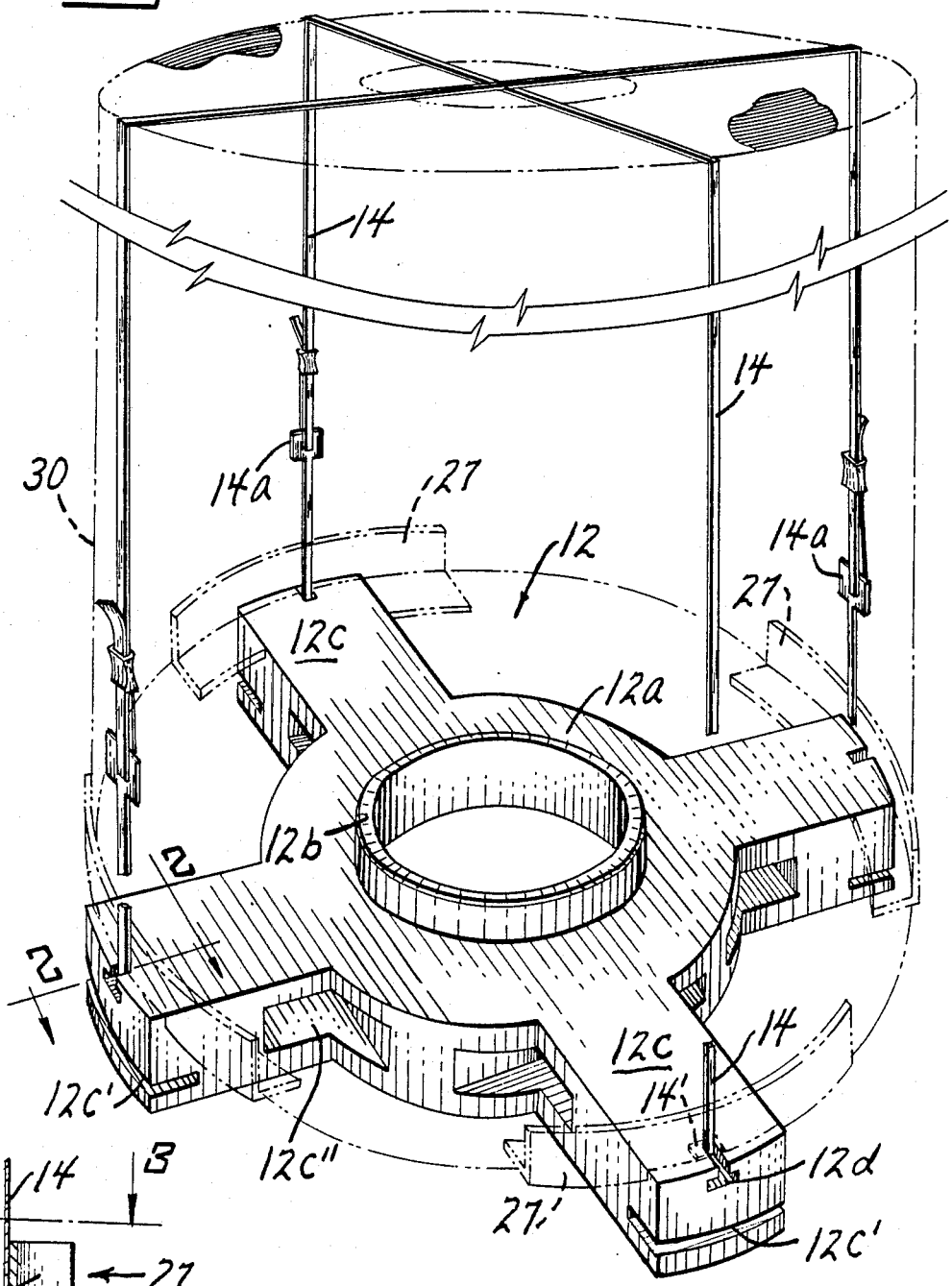
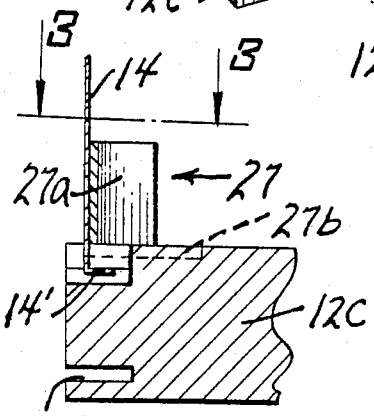
FIG. 2
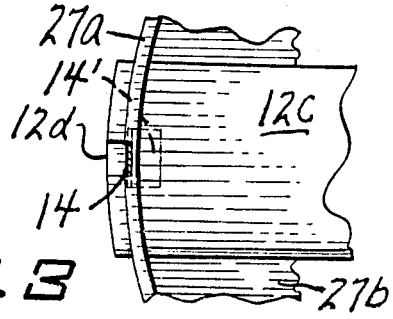
FIG. 3

FIG. 4
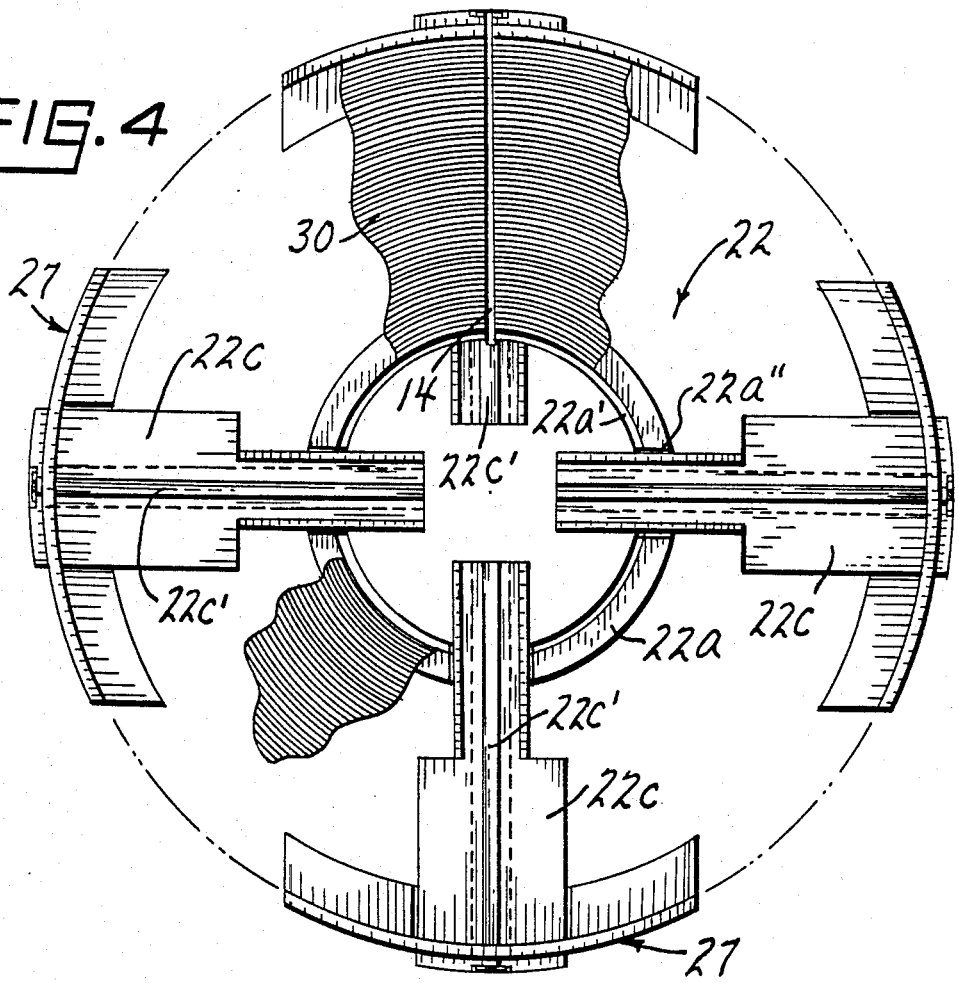
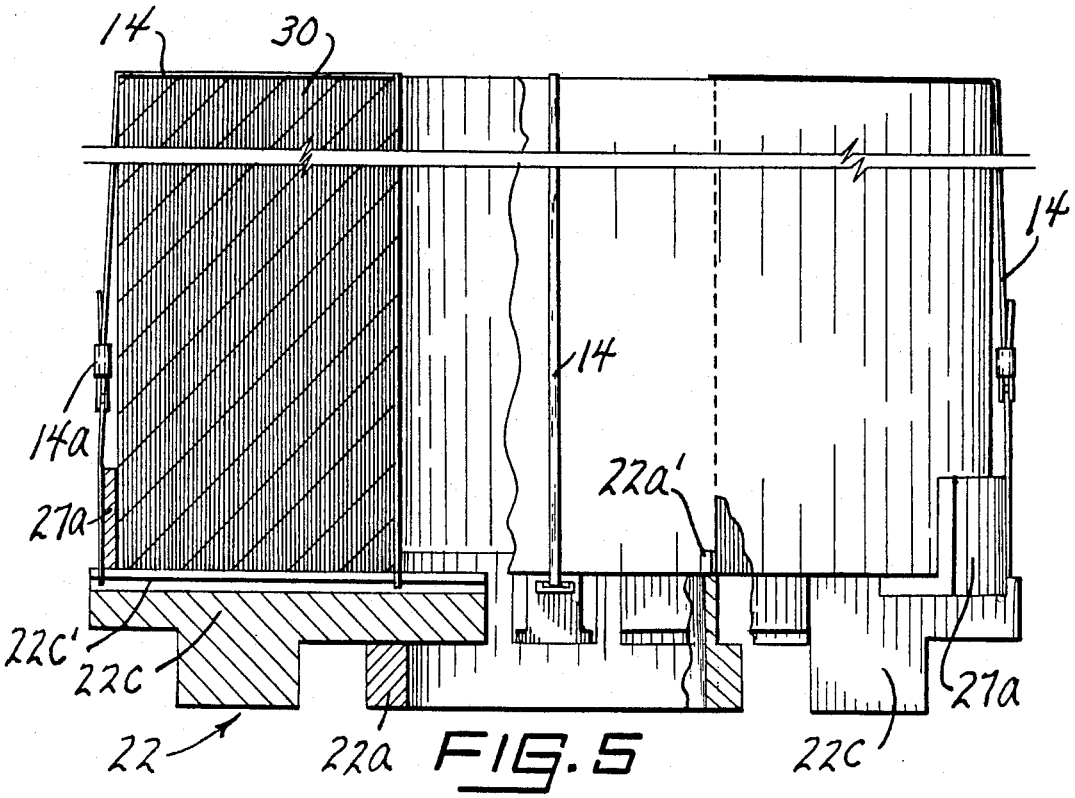
FIG. 5

MATERIAL TRANSPORTING ARRANGEMENT

As is known, a continual need arises, as in a production facility, for example, for a supply and/or inventory of material necessary for manufacturing. In this connection, rolled material, such as sheet metal stock, requires particular attention, both in storage and in transporting, to avoid damage and, as a result, waste and/or a loss in production time.

The invention overcomes and/or satisfies the preceding by presenting a material handling arrangement readily adaptable for rolled material transporting and/or storage, either by commonly used fork or lift trucks. The invention may be in alternative forms, although basically the same in concept, i.e. arranged as an integral unit or in separable co-operating units.

In the instance of an integral unit, rolled stock diameter controls overall size, whereas, with the separable arrangement, the diameter of the overall assembled units is adjustably accomplished. With the latter, a central core or hub is provided for receiving slidable arms which accommodate rolled stock size. In either form, the usage of a high density plastic resin serves for optimum fabrication and/or finished durability.

In any event, a better understanding of the present invention will become more apparent from the following description, taken in conjunction with the accompanying drawings, wherein

BRIEF DESCRIPTION OF THE FIGURES

FIG. 1 is a perspective view showing one form of material transporting arrangement in accordance with the teachings of the present invention;

FIG. 2 is a view in vertical section, partly fragmentary, taken at line 2—2 on FIG. 1 and looking in the direction of the arrows, further detailing this invention form;

FIG. 3 is a top plan view, also fragmentary, taken at line 3—3 on FIG. 2 and looking in the direction of the arrows, still further detailing such invention form;

FIG. 4 is a top plan view of another form of material transporting arrangement in accordance with the teachings of present invention; and, FIG. 5 is a view in side elevation, partly in vertical section and partly fragmentary, and looking upwardly on FIG. 4, detailing this other invention form.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Referring now to FIGS. 1, 2 and 3, one form of the invention is presented including an integral base member 12 having a centrally disposed core or hub **12*a* defined by an inner upstanding collar or wall 12*b*. Radial arms 12*c* extend outwardly from the aforesaid core 12*a***, typically in a 90° spaced-apart relationship.

As particularly evident in the figures, the end of each arm **12*c* includes an inverted T-shaped slot 12*d* (see FIG. 1) which serves to receive and retain each end 14' of a tie strap 14 overlaying the transported material 30, as, rolled sheet metal stock. The tie strap end 14'** is foldable and enlarged for retaining purposes.

Each arm **12*c* is further cut or slotted, at 12*c'*, to receive the operative arm mechanism of a lift truck (not shown) and, as well, a cavity 12*c''*** extends through each to receive the forks of a fork truck (also not shown).

The arrangement includes the use of protectors 27 to preclude or at least minimize coil edge damage, each presenting an upstanding rim **27*a* and a flat base 27*b* coplanar with the upper surface of the associated arm 12*c*. The protectors 27** may be made from paperboard, fiberboard or the like.

FIGS. 4 and 5 are directed to an invention form defined by five separable units, i.e. a base member 22 presenting a central hub or core **22*a* which includes laterally disposed openings or cut-outs 22*a''* for receiving load supporting arms or members 22*c*. Inwardly and outwardly sliding movement of the arms 22*c* serves to accommodate differences in rolled coil stock 30** diameters.

In any event, each of the load supporting arms **22*c* includes a longitudinal inverted T-shaped slot 22*c'* for receiving a free end of a tie strap 14 after the latter is overlaid on material 30. As before, the tie strap end is foldable and enlarged for retaining purposes. The transported material 30 is further confined in an operative condition by an upstanding inner peripheral collar or wall 22*a'* on the central core 22*a* (see FIG. 5), i.e. the hollow center of the rolled material 30** fits therearound.

As in the earlier described invention form, protectors 27 are also employed (apparent in FIGS. 4 and 5) and open space provided in the base member 22 for fork truck arms or the like.

In both invention forms, each of the components is typically made from a high density plastic resin, and the tie straps 14 include conventional buckles **14*a* for necessary tightening of the loaded rolled material 30** into position for transporting and/or storage.

It should be evident from the preceding that the material transporting arrangement of the invention, in both forms, serves to positively retain rolled sheet material by the simple attachment and tightening of tie straps where, in one invention form, the arrangement satisfies a specific rolled sheet material diameter and, in the second invention form, sliding movement of the arms permits adjustment for various sized diameters of rolled sheet material.

The described arrangements, however, are susceptible to various changes within the spirit of the invention, including proportioning; the precise material from which each form is fabricated; the configuration of the slots; the usage of a square (and solid) rather than a circular (and hollow) core of the base member and, as well, straight (rather than curved) ended arms; and, the like. Thus, the preceding should be considered illustrative and not as limiting the scope of the following claims:

I claim:

1. An arrangement for transporting rolled material comprising, in combination, a base member and a rolled material, said base member presenting a hollow core having an upstanding circular inner rim, a plurality of arms extending outwardly from said core, said core and said plurality of outwardly extending arms having upper coplanar surfaces on which the load of said rolled material is received, said rolled material being disposed on said upper coplanar surfaces in an encircling locating relationship with said upstanding circular inner rim, said upstanding circular inner rim extending above said coplanar surfaces, a tie strap extending from opposing outwardly extending arms and overlaying said rolled material, and slotted portions in said plurality of outwardly extending arms receiving free ends of said tie strap in a securing relationship between said free ends and said slotted portions.

2. The arrangement of claim 1 wherein opposing outwardly extending pairs of arms are in-line.

3. The arrangement of claim 1 where said slotted portions are in an inverted T-shaped configuration.

4. The arrangement of claim 1 where said slotted portions are longitudinally disposed and open-ended.

5. The arrangement of claim 1 where said base member and said outwardly extending arms include recessed portions receiving material handling equipment.

6. The arrangement of claim 1 where said hollow core slidably receives said plurality of outwardly extending arms.

7. The arrangement of claim 6 where said hollow core includes recesses into which said outwardly extending arms slide.

8. The arrangement of claim 1 where said hollow core is circular and where arms extend radially therefrom.

* * * * *